US007740001B2

(12) United States Patent
Yudanov

(10) Patent No.: US 7,740,001 B2
(45) Date of Patent: Jun. 22, 2010

(54) FUEL INJECTION SYSTEM

(75) Inventor: Sergi Yudanov, V. Frölunda (SE)

(73) Assignee: Volvo Lastvagnar AB, Gothenburg (SE)

( * ) Notice: Subject to any disclaimer, the term of this patent is extended or adjusted under 35 U.S.C. 154(b) by 139 days.

(21) Appl. No.: 12/280,800

(22) PCT Filed: Mar. 10, 2006

(86) PCT No.: PCT/SE2006/000316

§ 371 (c)(1),
(2), (4) Date: Aug. 27, 2008

(87) PCT Pub. No.: WO2007/105991

PCT Pub. Date: Sep. 20, 2007

(65) Prior Publication Data

US 2008/0308064 A1 Dec. 18, 2008

(51) Int. Cl.
*F02B 3/10* (2006.01)
*F02B 3/00* (2006.01)

(52) U.S. Cl. ..... 123/299; 123/304

(58) Field of Classification Search ..... 123/299, 123/300, 304, 295, 430, 575, 576, 79 R, 79 C
See application file for complete search history.

(56) References Cited

U.S. PATENT DOCUMENTS 3,339,848 A * 9/1967 Geiger ..... 239/453
6,298,833 B1 * 10/2001 Douville et al. ..... 123/527
2004/0134465 A1 7/2004 Boltz

FOREIGN PATENT DOCUMENTS

DE 10305509 A1 8/2004
EP 1275840 A2 1/2003
EP 0980475 B1 4/2003

OTHER PUBLICATIONS

International Search Report for corresponding International Application PCT/SE2006/000316.

International Preliminary Report on Patentability for corresponding International Application PCT/SE2006/000316.

* cited by examiner

*Primary Examiner*—Mahmoud Gimie
(74) *Attorney, Agent, or Firm*—WRB-IP LLP

(57) ABSTRACT

A fuel injection system for an internal combustion engine is provided for providing an injection event including a first stage and a second stage via a single nozzle. The nozzle is connected by its inlet port to a source of variable fuel pressure and it includes a needle valve for performing the first stage of injection, and a poppet valve for performing the second stage of injection. The first and second stages of injection are selectable by controlling the fuel pressure in the inlet port which is common for both the needle valve and the poppet valve.

16 Claims, 4 Drawing Sheets

FUEL INJECTION SYSTEM

BACKGROUND AND SUMMARY

The present invention relates to a fuel injection system for an internal combustion engine, for providing an injection event comprising a first stage and a second stage via a single nozzle which is connected by its inlet port to a source of variable fuel pressure, said nozzle including a needle valve for performing the first stage of injection, and a poppet valve for performing the second stage of injection.

The present invention concerns fuel injection systems of internal combustion engines, in particular systems for injection of fuel directly into combustion cylinders of compression ignition engines.

Compression ignition or diesel engines will, according to most forecasts, remain the dominant mechanical power source for transportation, construction and other machinery in the foreseeable future. However, depletion of reserves and rising cost of crude oil that at the present time remains practically the only source of fuel for diesel engines, initiate efforts aimed at finding alternative fuels suitable for diesel engines. One particularly promising fuel, both in terms of its environmental characteristics and suitability for efficient diesel operation, is dimethyl ether, or DME. Chemical and thermodynamic properties of DME significantly differ from that of traditional diesel fuel though, requiring optimization of fuel injection system to ensure efficient, operation of same and thus of engine as a whole.

Among the most important differences between DME and traditional diesel fuel oil are significantly lower calorific value and density of the former and vastly greater sooting tendency of the latter. The lower calorific value and density of DME, combined, make it necessary to inject almost twice the volumetric amount compared to diesel oil in order to obtain the same engine power. The difficulties of creating high DME injection pressures, arising from its much poorer lubricity, lower viscosity and greater compressibility, make it necessary to utilize nozzles with very large flow areas to achieve the high flow rates and injected volumes. This creates certain difficulties for conventional diesel nozzle designs featuring a needle valve controlling flow to spray orifices, arising from too large orifice number and diameter required. On the other hand, the much lower sooting tendency of DME presents the advantage of being able to utilize the other type of nozzle where large flows are easily attainable but which cannot be used in contemporary diesel oil-fueled engines due to in that case unacceptably high soot emissions.

One such nozzle type is a poppet nozzle with the poppet opening outward against the forces of a return spring and backpressure in the combustion chamber of the engine. The use of nozzles of this type had been discontinued in the diesel engine industry long time ago, although later on there have been attempts, so far not reaching commercial application, to revive the concept, driven by either the relative simplicity of the design or its suitability for being adapted for two-stage operation. An example of a more recent development is disclosed in the U.S. Pat. No. 6,513,487 B1. In that design, a poppet nozzle's not-so-favourable for diesel combustion property of very quick opening of a large flow area with fuel sprayed in the form of a hollow cone, is attempted to be eliminated through the use of a cylindrical poppet guide extending all the way down to the main tapered seat of the poppet, such that the bottom edge of the nozzle body guide surface provides a spool-like area control for the spray orifices formed in the poppet guide in the vicinity of the poppet seat. This solution allows the use of spray holes of axially elongated shape and/or multiple rows of holes having different size/direction for control of initial combustion rates etc., as disclosed in the document. Operation on DME, thanks to low sooting quality of the fuel, is likely to be forgiving to this design's propensity to fuel splashing and fuel film formation on external nozzle surfaces, but the exposure of the guide, which has to be relatively closely matched for effective orifice edge control, to the hot and contaminating environment of the engine combustion gases can severely undermine reliability of function. Therefore, the more traditional designs of the poppet valves with waisted stem portion adjacent to the poppet seat, have better prospects in terms of reliability.

As indicated by research and experience, the DME diesel combustion process can, in terms of NOx-soot-BSFC tradeoffs, benefit from careful control of the injection rate in the beginning of fuel injection. Even pilot injections can be beneficial in certain conditions. Achieving that can however be complicated by the fact that the maximum flow area of the nozzle has to be large due to reasons explained above, and is certainly difficult in case of a poppet nozzle which normally tends to open a large area quickly in the beginning of injection. The present invention addresses this difficulty by providing simple and effective means of accurately controlling pilot injections and initial rate of injection in a poppet type of nozzle.

A prior art injector system with certain similarity is described in EP 0980475B1. That system is designed for operating with two fuels simultaneously, one of the fuels being a pilot fuel for igniting the other, main fuel such as natural gas. The injector is consequently a complex apparatus with multiple inlet/outlet ports and is additionally complicated by separate valves for relieving the pressure of actuating fluid used to open the nozzle etc.

It is desirable to provide a fuel injection system with relatively large maximum nozzle flow area, such as that required for injecting relatively low-density and low specific heat fuels, for instance DME, which is capable of producing pilot injections and achieving rate shaping in the beginning of injection with good accuracy and fuel spray quality, it is desirable to provide a double-stage nozzle with a needle valve capable of opening spray orifices with relatively small flow area during a first stage of fuel injection, designed for delivering fuel at a slower and accurately controlled rate, and with a poppet valve capable of opening relatively large flow area and achieving relatively high injection rate when moving outwards toward the engine combustion chamber in a second stage of fuel injection.

It is desirable to provide a fuel pressure-controlled double-stage nozzle in which the activation of the first and second stages of injection can be selected by controlling the pressure at the inlet of the nozzle, and in which the operation of the needle valve can also be controlled by the movement of the poppet valve for achieving better injection characteristics.

The fuel injection system according to an aspect of present invention contains a source of variable fuel pressure to which an inlet port of a nozzle is connected. The nozzle incorporates a poppet valve which has a poppet and is biased by a poppet return spring towards its closed position, in which the poppet abuts against a poppet seat formed on the nozzle and closes a flow area between them, through which fuel under pressure can otherwise be injected out of the nozzle and into engine's combustion chamber. The area of the poppet valve enclosed within the diameter of the poppet seat is exposed to the pressure in the inlet port which can, upon rising to a predetermined level defined by the seat diameter, poppet return spring preload and backpressure outside the nozzle, open the nozzle by moving the poppet valve toward the combustion chamber of the engine against the force of the poppet return spring and of the pressure in the combustion chamber.

There is a bore in the poppet valve which extends axially from the top of the valve and terminates by at least one injection orifice in the bottom part of the poppet valve, the injection orifice opening out to the combustion chamber of the engine. A needle valve is installed in this bore, with a cylindrical guide in its upper portion producing a precision-matched sliding fit with the bore. The needle valve also has a seat formed on its bottom portion which can engage with the bottom of the bore to close the fluid communication between the bore and the injection orifice. The volume of the bore confined between the needle valve seat and the needle guide is always connected to the inlet port of the nozzle. A spring cap fitted at the top of the poppet valve, the guide of the needle valve and the bore form a needle spring chamber in which a needle return spring is installed that biases the needle to close the injection orifice, in use, the spring cap does not allow fluid communication between the needle spring chamber and a poppet spring chamber.

The poppet valve and the nozzle body form a precision-matched poppet guide in which the poppet valve can slide up and down to close and open the nozzle. A return channel is provided in the nozzle body which opens up onto the poppet guide, either directly or via an annular return groove. An outlet control orifice for connection of the needle spring chamber to the return channel is provided in the poppet valve such that the positions of the needle valve and the poppet valve can control the flow area of this outlet control orifice. Similarly, there is a supply channel in the nozzle body, which is connected to the inlet port and which, on the other end, opens up onto the poppet guide, either directly or via an annular supply groove. An inlet control orifice for connection of the needle spring chamber to the supply channel is provided in the poppet valve such that the position of the poppet valve can control the flow area of this inlet control orifice. The clearance in the poppet guide is sufficiently small to minimize leakage of pressurised fuel along the guide and to ensure necessary reduction of flow in control orifices upon their overlapping with the edges of the channels or annular grooves in the nozzle body.

In the closed position of the nozzle, the needle spring chamber is connected by the outlet control orifice to the return channel and is disconnected from the inlet control orifice because of the misalignment between the inlet control orifice and the supply channel, such that the pressure in the needle spring chamber equals the return port pressure. The opening pressure of the needle valve is set by an appropriate combination of the needle return spring preload and the size of the needle differential area (defined by the needle guide diameter and the needle seat diameter) to be lower than the opening pressure of the poppet valve. When the pressure in the inlet port rises for the first stage of the injection process to begin, the needle valve opens allowing fuel to be injected through relatively small injection orifices in the poppet.

When injection at a higher rate is required, the pressure in the inlet port is increased further and above the opening pressure of the poppet valve, which then moves downward and opens a large flow area between the poppet and its seat allowing fuel to escape from the poppet pressure chamber out to the combustion chamber, thereby commencing a second stage of the injection. During this downward movement of the poppet valve, the outlet control orifice becomes overlapped by the edge of the return channel or groove, closing the flow path from the needle spring chamber to the return port. Further opening of the poppet valve aligns the inlet control orifice with the supply channel so that the fuel under pressure flows into the needle spring chamber and assists the needle return spring in closing the needle valve. Thus the needle valve can be closed quickly upon opening of the poppet valve.

To end the injection, the pressure in the inlet port is reduced below a level that can keep the poppet valve open against the force of the poppet return spring and the backpressure in the combustion chamber. The poppet valve then moves upward and closes whilst the needle valve remains closed by the force of the needle return spring.

By these means, a fuel injection system with a double-stage nozzle is provided that allows for accurate control of small fuel deliveries necessary for idle and low load operation of the engine, for effective rate-shaping of injection and for achieving high flow rates of injection of large fuel quantities, at the same time ensuring low control leakages and a relatively simple design. Additionally, the system achieves quick end of injection.

The number, direction and the total flow area of the injection orifices, on one hand, and the poppet nozzle settings, on the other hand, can be optimised independently to ensure the best fuel distribution and rate of injection required in different engine operating conditions, typically low load and speed operation as opposed to high-load operation. The selection of either needle or poppet valve to be open, and the duration of their opening, is made through controlling the fuel pressure in the inlet port of the nozzle, which can be carried out in a number of ways that are known in the art and that will be reviewed in more detail in the following sections of the description.

BRIEF DESCRIPTION OF THE DRAWINGS

The invention will be further described in the following, in a non-limiting way with reference to the accompanying drawings in which.

DETAILED DESCRIPTION

Figure 1:
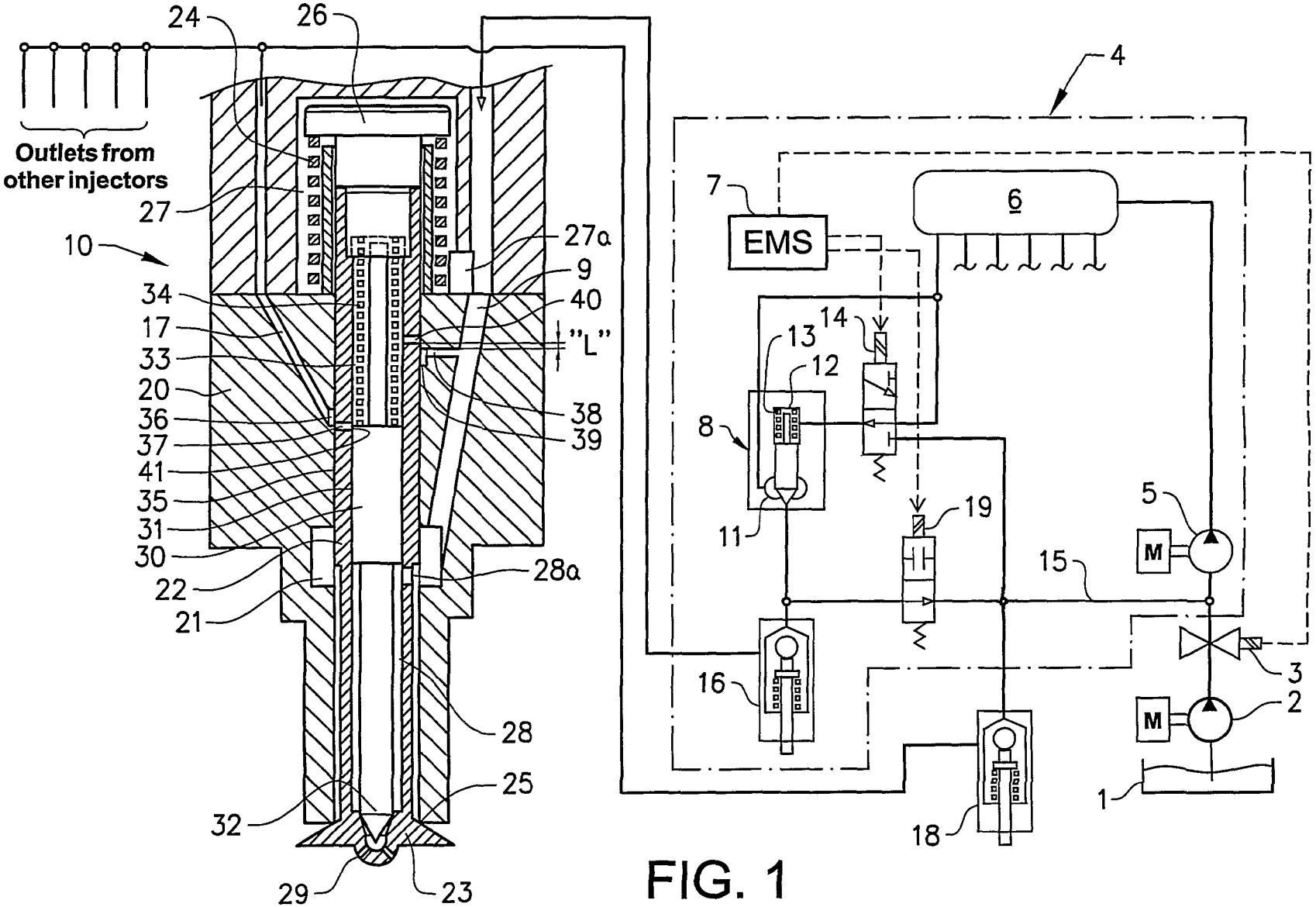
FIGS. 1 and 2 are schematic representations of a preferred embodiment of the fuel injection system according to present invention, shown in different stages of operation.

In the preferred embodiment, the fuel injection system according to present invention contains a fuel tank 1, a feed pump 2 and associated components (not shown), a conventional isolating valve 3, a source of variable pressure 4 comprising a high-pressure pump 5, a common rail 6, to which a plurality of injectors are connected, and an engine management system (EMS) 7. A hydraulically operated valve 8 is connected between the common rail 6 and the inlet 9 of a nozzle 10, the inlet of the hydraulically operated valve 8 being connected to the common rail 6. The hydraulically operated valve preferably has a precision-matched stem and forms an outlet chamber 11 and a control chamber 12, and is preferably biased towards its closed position by a resilient means 13. The control chamber 12 of the valve 8 can be connected by a three-way pilot valve 14 to either the common rail 6 or a return conduit 15, depending on commands from the EMS 7. The outlet of the hydraulically operated valve 8 is connected to the inlet 9 of the nozzle 10 via a differential hydraulic valve 16. A return channel 17 of the nozzle 10 is connected via another differential hydraulic valve 18 to the return conduit 15. Preferably, the nozzle return channels of other injectors of the engine are connected to the return conduit via the same valve 18 as shown. A spill valve 19 that is controlled by the EMS 7, is connected between the outlet of the hydraulically operated valve 8 and the return conduit 15.

The differential hydraulic valve 16, 18 is designed such that, once it is open, the area of the valve that is exposed to the pressure of the fuel is sufficiently big to hold the valve open against the force of the valve's return spring when the pressure in the valve is anywhere from slightly below the feed pressure in the system or above that level. In case of engine being stopped and the feed pressure falling below a predetermined level, the differential hydraulic valve closes and the area of the valve exposed to the pressure upstream of the valve becomes relatively small, such that a pressure above the feed pressure level is required to re-open the valve 16. The design of such a valve is known in the art and is disclosed, for example, in the U.S. Pat. No. 6,189,517 B1.

The nozzle 10 has a body 20 with a pressure chamber 21 connected to the inlet port 9, in which a poppet valve 22 is installed. The poppet valve has a poppet 23 and is biased by a poppet return spring 24 towards its closed position, in which the poppet abuts against a poppet seat 25 formed on the nozzle 10, and closes a flow area between them, through which fuel under pressure can otherwise be injected from the pressure chamber 21 out of the nozzle and into engine's combustion chamber (not shown). The poppet return spring 24 acts on a spring cap 26 fitted on the poppet valve, and is installed in a poppet return spring chamber 27 which is connected to the inlet port 9 via an opening 27*a*. The fuel system is designed such that the area of the poppet valve enclosed within the diameter of the poppet seat 25 is exposed to the pressure in the inlet port 9 which can, upon rising to a predetermined level defined by the seat diameter, poppet return spring preload and backpressure in the engine combustion chamber, open the nozzle by moving the poppet valve toward the combustion chamber of the engine against the force of the poppet return spring and of the pressure in the combustion chamber.

There is a bore 28 in the poppet valve 22 which communicates with the pressure chamber 21 via a passage 28*a*, which bore 28 extends axially from the top of the valve and terminates by at least one injection orifice 29 in the bottom part of the poppet valve, the injection orifice opening out to the combustion chamber of the engine. A needle valve 30 is installed in this bore, with a cylindrical guide 31 in its upper portion producing a precision-matched sliding fit with the bore 28. The needle valve 30 also has a seat 32 formed on its bottom portion which can engage with the bottom of the bore to close the fluid communication between the bore 28 and the injection orifice 29. The volume of the bore confined between the needle valve seat 32 and the needle guide 31 is always connected to the pressure chamber 21 of the nozzle. The spring cap 26 fitted at the top of the poppet valve, the guide 31 of the needle valve and the bore 28 form a needle spring chamber 33 in which a needle return spring 34 is installed that biases the needle 30 to close the fluid communication between the bore 28 and the injection orifice 29. The fitted loads of the needle return spring 34 and the poppet return spring 24 can be adjusted in a well-known way by selecting appropriate thicknesses of respective washers or shims (not shown) installed, for example, between the poppet and the spring cap 26. In use, the spring cap 26 does not allow fluid communication between the needle spring chamber 33 and the poppet spring chamber 27.

The poppet valve 22 and the nozzle body 20 form a precision-matched poppet guide 35 in which the poppet valve can slide up and down to close and open the nozzle. The return channel 17 opens up onto the poppet guide, either directly or via an annular return groove 36. An outlet control orifice 37 for connection of the needle spring chamber 33 to the return channel 17 is provided in the poppet valve 22 such that the positions of the needle valve and the poppet valve can control the flow area of this outlet control orifice. Similarly, there is a supply channel 38 in the nozzle body, which is connected to the inlet port 9 and which, on the other end, opens up onto the poppet guide, either directly or via an annular supply groove 39. An inlet control orifice 40 for connection of the needle spring chamber 33 to the supply channel 38 is provided in the poppet valve such that the position of the poppet valve can control the flow area of this inlet control orifice. The clearance in the poppet guide 35 is sufficiently small to minimize leakage of pressurised fuel along the guide and to ensure necessary reduction of flow in control orifices 37, 40 upon their overlapping with the edges of the channels 17, 38 or annular grooves 36, 39 in the nozzle body.

To transport the fuel to be injected from the inlet port 9 and the pressure chamber 21 down to the poppet 23, several methods known in the art can be used separately or simultaneously. The one exemplified schematically in FIG. 1, uses a waisted section in the lower portion of the poppet 22. In real life, a guide section close to the poppet may be required with, for example, longitudinal grooves made on its periphery for the passage of fuel, but an illustration of this is omitted in the present description for simplicity.

Referring to FIG. 1, the fuel injection system according to the present invention works as follows: In a no-injection state but with the engine running, the isolating valve 3 is open, there is feed pressure downstream of the feed pump 2 and in the return conduit 15; the high-pressure pump pressurizes the fuel to a certain level and maintains that level in the common rail 6. The valves 14 and 19 are not activated by the EMS 7.

The three-way pilot valve 14, in its de-activated position, connects the common rail 6 to the control chamber 12 of the hydraulically operated valve 8. The pressure from the common rail, combined with the force of the resilient means 13, holds the valve 8 in its closed position. The spill valve 19 is open, connecting the outlet of the hydraulically operated valve 8 to the return conduit 15. The differential hydraulic valves 16, 18 are open, and pressure in the nozzle 10 equals pressure in the return conduit 15. The nozzle is closed by the needle return spring 34 and a combined force of the poppet return spring 24 and the backpressure acting on the poppet 23. There is a fluid connection between the needle spring chamber 33 and the return channel 17 through the outlet control orifice 37. In the closed position of the poppet 22 as shown in FIG. 1, the inlet control orifice 40 is offset from the supply channel 38 by a distance "L" such that there is no direct fluid communication between the needle spring chamber 33 and the inlet port 9 of the nozzle.

To begin an injection, the EMS applies a control current to the pilot valve 14, which disconnects the control chamber 12 of the hydraulically operated valve 8 from the common rail 6 and connects it to the return conduit 15. The pressure in the control chamber 12 fails and allows the common rail pressure acting on the valve 8 from the outlet chamber 11 to open the valve 8 against the force of the resilient means 13. At about the same time, the EMS closes the spill valve 19, so that the fuel cannot escape to the return conduit 15 while the hydraulically operated valve 8 is open. Fuel pressure in the line connecting the outlet chamber 11 of the valve 8 and the nozzle inlet 9 rises and, upon reaching a needle valve opening pressure, moves the needle valve 30 upwards opening the flow path from the pressure chamber 21 to the injection orifices 29 and thus beginning an injection. During the upward movement, the needle 30 displaces fuel from the needle spring chamber 33 out to the return channel 17 through the outlet orifice 37. The relative position of the top edge 41 of the needle guide 31 and the outlet control orifice 37 may be arranged such that the edge 41 closes the connection between the needle spring chamber 33 and the outlet control orifice 37 as the needle 30 is lifted up.

Figure 2:
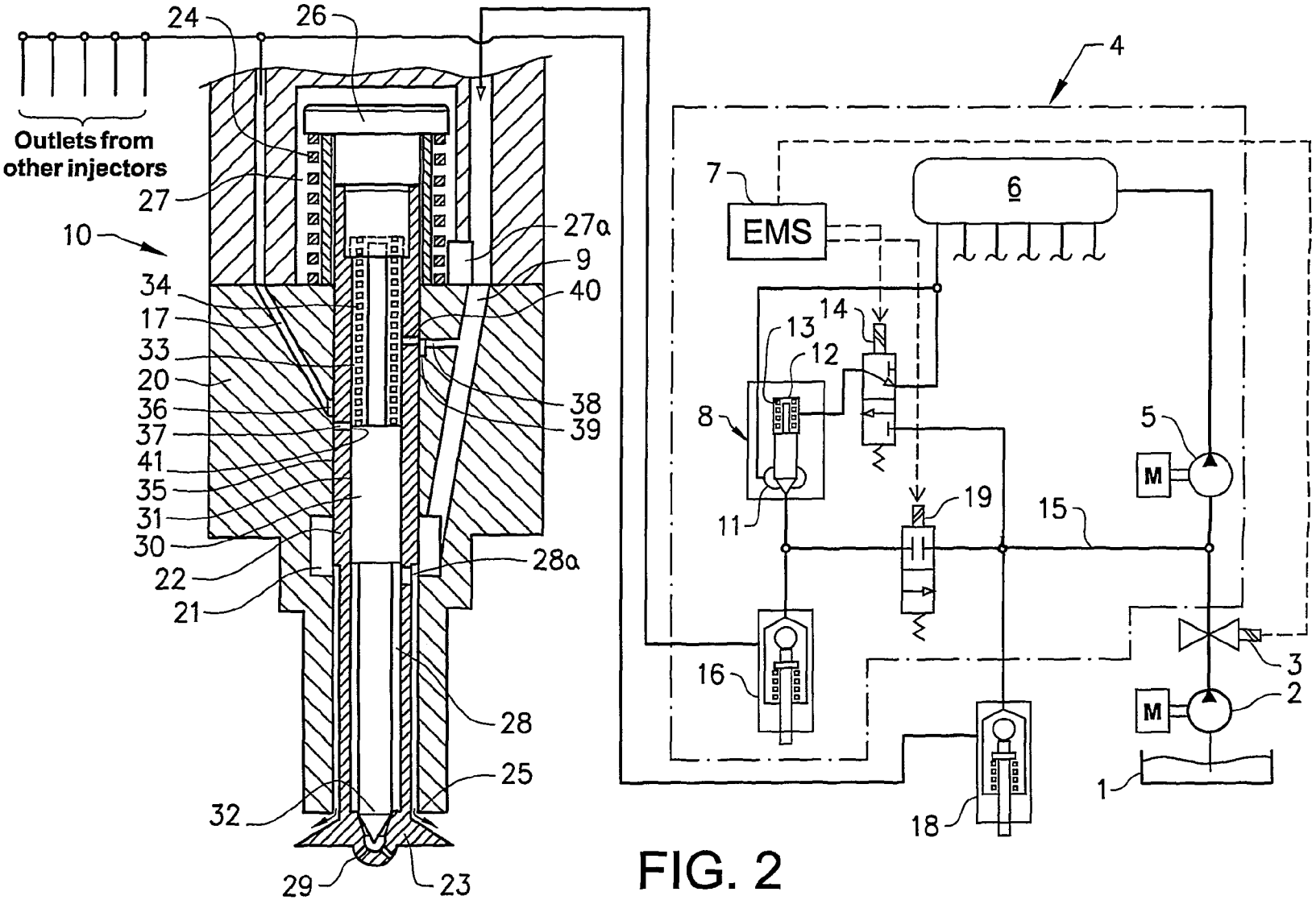

When the pressure in the inlet port 9 increases further and exceeds a poppet valve opening pressure, the poppet valve 22 begins to move downward opening a flow path between the poppet 23 and the seat 25, initiating an injection of fuel into combustion chamber at a relatively high rate as the open area between the poppet and its seat increases quickly. When moving downward, the poppet valve 22 closes the fluid communication between the outlet control orifice 37 and the return channel 17 and opens the connection from the inlet port 9 to the needle spring chamber 33 via the supply channel 38 and the inlet control orifice 40. Preferably, the lift of the poppet valve that is required to completely close the flow area between the outlet control orifice 37 and the return channel 17, is equal or less than the distance "L" shown in FIG. 1 and denoting the lift required to open the flow area between the supply channel 38 and the orifice 40. By these means, the opening of the poppet valve 22 pressurises the needle spring chamber 33 which, in turn, assists the needle return spring 34 in quickly closing the needle valve 30. With the needle valve 30 being closed, the main injection occurs through the area open by the poppet 23 as long as the pressure in the inlet port 9 is high enough to keep the poppet valve open. This operating state of the fuel injection system is illustrated in FIG. 2.

To terminate the injection, the EMS de-activates the pilot valve 14, which then disconnects the control chamber 12 from the return conduit 15 and connects it back to the common rail. The pressure in the control chamber 12 rises and, together with the resilient means 13, forces the valve 8 down towards the closed position. During the closing period of valve 8 and corresponding reduction of its flow area, the fuel continues to be injected from the open nozzle and the pressure in the nozzle falls. When the poppet valve is still being around its fully open position as shown in FIG. 2, the pressure in the needle spring chamber 33 is essentially equal to pressure in the pressure chamber 21 and the needle valve is kept closed by the spring 34. With a further reduction of nozzle pressure, the poppet, valve begins moving upward closing the nozzle, at the same lime switching the needle spring chamber 33 back from the inlet port 9 to the return channel 17 with its low pressure. This may cause a secondary opening of the needle valve 30 in case the pressure decay in the nozzle is slow. To prevent such secondary opening of the needle valve, the EMS can deactivate and open the spill valve 19 immediately after the hydraulically operated valve 8 has closed. This quickly reduces pressure in the nozzle and the system returns to its initial position as depicted by FIG. 1.

In case an injection with a quick initial ramp-up of injection rate and a high mean injection rate is required, the pressure in the inlet port 9 can be controlled to increase quickly by, for instance, setting the common rail pressure at a relatively high level and activating the hydraulically operated valve by a single continuous control pulse. To reach even quicker pressure increase in the beginning of injection, the spill valve 19 can be closed with a delay relative to start of activation of the pilot valve 14, so that injection will be started at a higher lift of the hydraulically operated valve 8.

In case a relatively long period of fuel injection with a slow rate is required before a high-rate injection is to take place, the EMS can briefly de-activate the pilot valve 14 shortly after its initial activation to start the injection. Then, the hydraulically operated valve 8 can develop only a partial first opening and then close again for a short period of time, delaying the pressure build-up in the nozzle such that only the needle valve 30 will remain open ensuring a slow rate of injection. In other cases, when a high-rate injection is not necessary at all such as at idle or very low loads, the operation of only the needle valve can be selected by setting the pressure in the common rail 6 to a relatively low level which cannot exceed the opening pressure of the poppet valve 22. Due to opening a relatively small flow area, by the needle valve, sufficiently small injection quantities can then be injected at relatively high pressure and with good accuracy. Thus, the present invention offers better turn-down ratio and significantly enhanced rate-shaping capability than prior art systems.

When the engine is stopped, the pressure in the common rail can be reduced down to the tank pressure by, for example, activating the pilot valve 14 while keeping the spill valve 19 open, and then the isolating valve 3 can be closed. This, if there is any leakage of fuel from the system downstream of the isolating valve, leads to a reduction of pressure in the differential hydraulic valves 16, 18 which then automatically close and thereby limit the amount of fuel that can leak through closed nozzles into the engine. This is because the valves 16, 18 in this case separate the relatively large volumes of common rail and associated components that may contain any residual pressure, from the nozzles.

Figure 3:
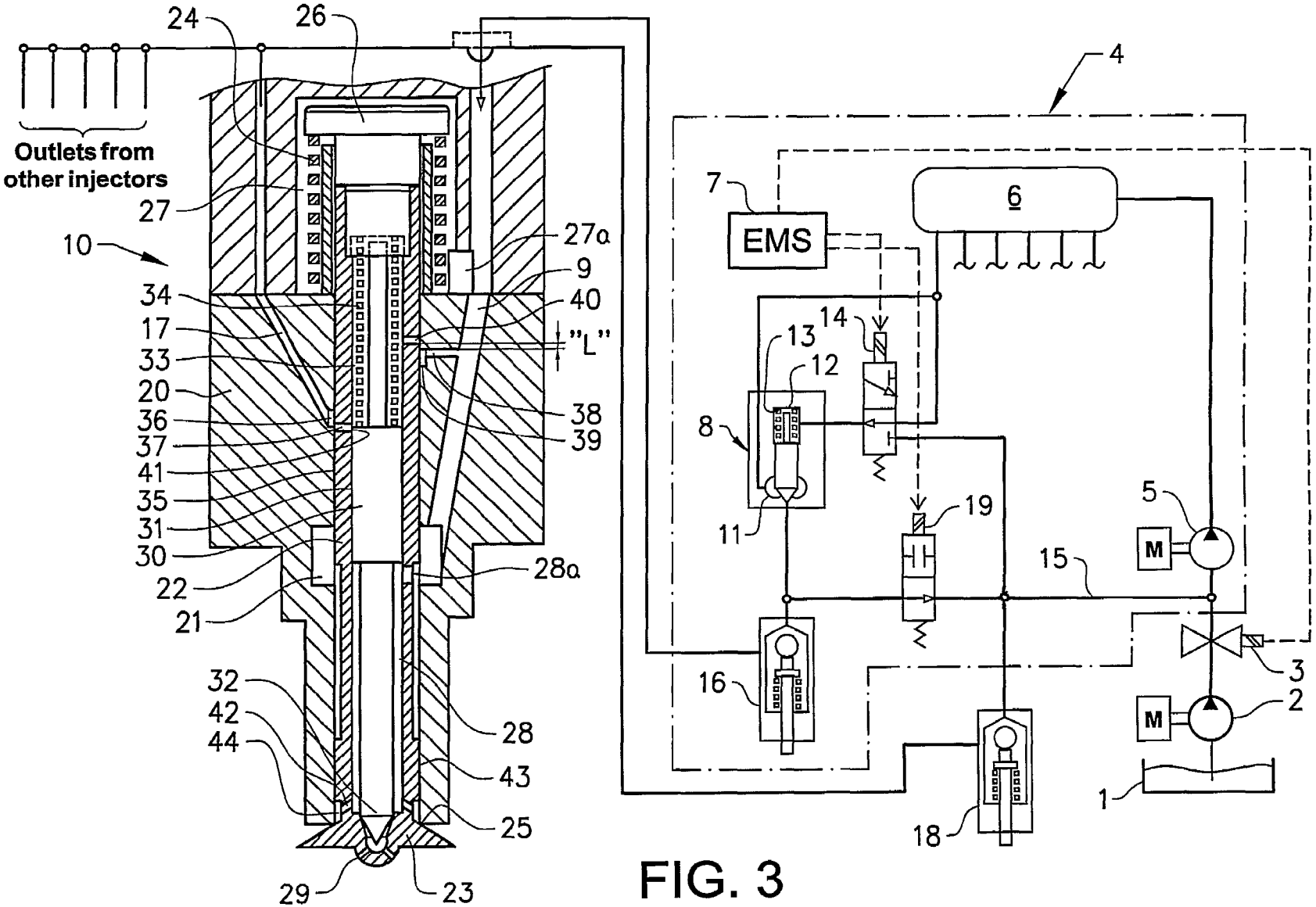
FIGS. 3 and 4 are schematic representations of two alternative embodiments of the invention.

In FIG. 3, an alternative embodiment of the present invention is shown, which is identical to the previously described embodiments in all but the design of the lower portion of the poppet valve. In this alternative embodiment, fuel from the compression chamber 21 is delivered to the poppet seat area from inside the bore 28 via spray orifices 42. The poppet has a cylindrical bottom guide section 43 in its lower portion which is closely matched with the nozzle body and only allows negligible amount of fuel to pass along the clearance in the guide during opening of the poppet valve. A portion 44 of the bottom guide section which is immediately adjacent to the poppet has an increased clearance as compared to the clearance in the guide section 43 and the spray orifices 42 open up, at least partially, on this clearance portion 44. The orifices 42 are directed such that, when the poppet valve is moved downward sufficiently far, at least by the height of the spray orifices, the fuel jets emerging from them can propagate without collision with the nozzle body and poppet through to the engine combustion chamber. In this embodiment of the invention, higher lifts of the poppet valve 22 can be set without excessive increase in the total flow area of the poppet nozzle, because it is limited by the flow area of the orifices 42. An excessive flow area in the poppet nozzle can lead to undesirably high pressure loss in the hydraulic restrictions upstream of the nozzle and, as a consequence, too low pressure of injected fuel with resulting poor fuel distribution in the combustion chamber of the engine. A high lift of the poppet valve 22 can be an advantage as it allows easier control of the flow areas of the inlet and outlet control orifices 37 and 38 through wider tolerances on the relative positions of these orifices with their respective control edges. Injecting fuel in distinct jets formed by spray orifices 42 rather than in a continuous cone-shaped stream characteristic to an ordinary poppet nozzle can also be advantageous with certain types of combustion systems. The provision of the clearance portion 44 helps alleviate possible problems of contamination of the poppet guide.

Figure 4:
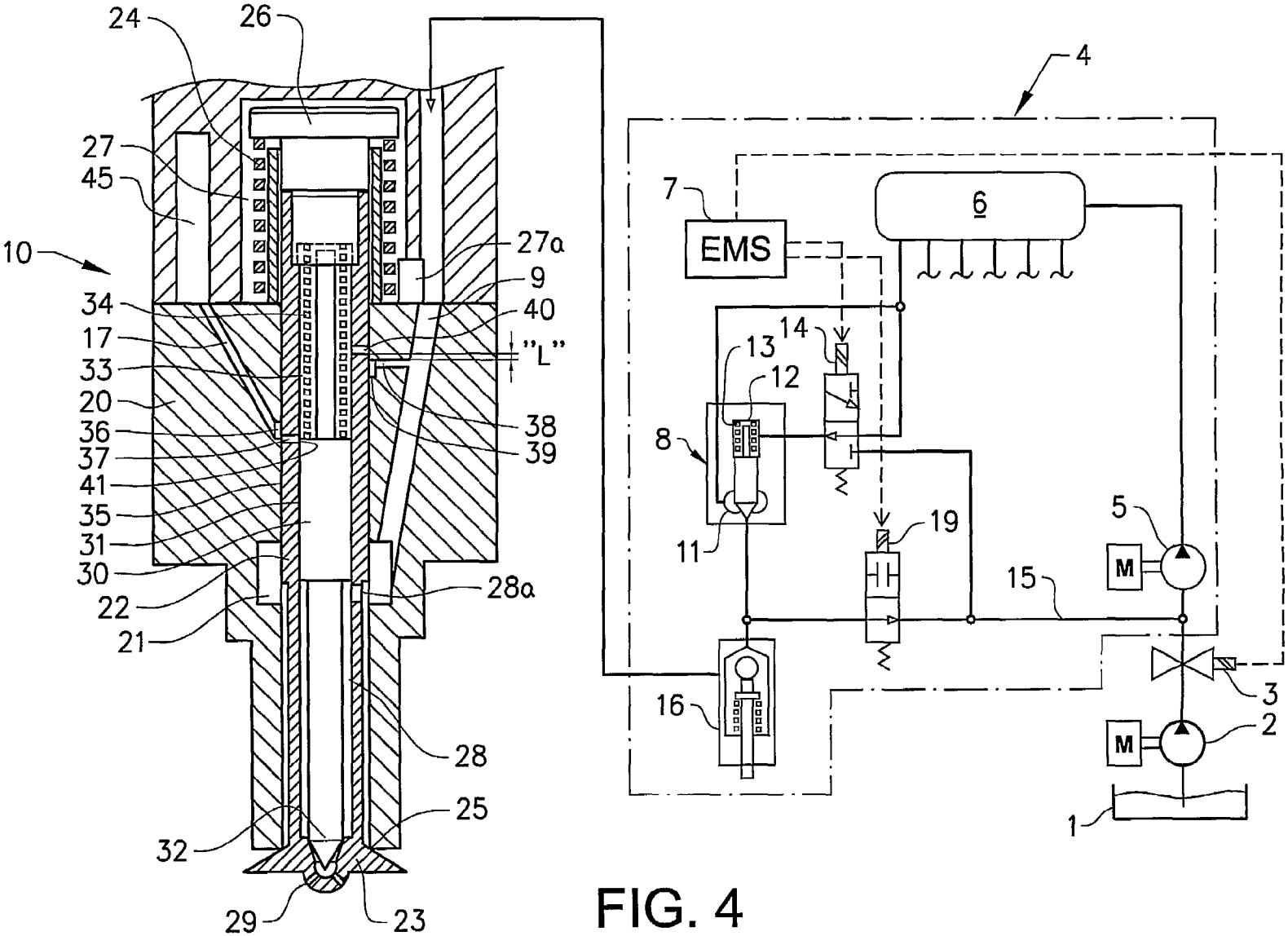

FIG. 4 shows another alternative embodiment of the invention in which the return channel 17 of the nozzle 10 is connected to a transfer volume 45 instead of being connected to the return conduit 15. The fuel injection system according to this embodiment works in the same way as other embodiments previously described, but fuel from the needle valve spring chamber 33 is displaced during the opening of the needle valve to this transfer volume 45, causing a pressure rise in it, and then the opening of the poppet valve 22 locks this pressure up until the poppet valve closes the nozzle again. Before, and during closing of the poppet valve, the pressure in the nozzle and therefore in the needle spring chamber 33 is reduced as described until the poppet-valve reaches a position when the connection between the needle spring chamber and the supply channel 38 is closed. Further movement of the poppet valve towards its closed position opens the connection between the return channel 17 and the outlet control orifice 37 that communicates with the needle spring chamber. This causes the pressure stored in the transfer volume 45 to be released into the needle spring chamber 33, which helps keep the needle valve closed in the final stages of poppet valve closing. Any residual pressure left in the transfer volume and the needle spring chamber after the end of injection is relieved through clearances in the guides 31, 35 during the relatively long time periods between consecutive injections. Therefore, the provision of the transfer volume 45 and connecting the return channel 17 to this transfer volume instead of connecting it to the return conduit 15, as in the previously described embodiments, can suppress unwanted secondary injections by the needle valve 30 and, additionally, simplify the design of the fuel injection system by eliminating extra connection of the nozzle to the return conduit 15 and the necessary in that case differential hydraulic valve 18.

The invention is not limited to the above-described embodiments, but several modifications are possible within the scope of the following claims. For example, the volume of the return channel 17 can be designed to be sufficiently large to act as a transfer volume itself, such that no separate transfer volume 45 is required.

Alternatively, the needle spring chamber 33 can itself be made sufficiently large to absorb the volume of fuel displaced by the needle 30 during its opening such that the pressure rise in this chamber does not prevent the needle 30 from opening, eliminating in that case the need of outlet control orifice 37. Return springs 24, 34 can be substituted by other suitable resilient means. Valves 8, 14, 19, 16, 18 can be incorporated in the injector(s) or be placed remotely and connected with the injectors by pipes.

The invention claimed is:

1. A fuel injection system for an internal combustion engine, for providing an injection event comprising a first stage and a second stage via a single nozzle which is connected by its inlet port to a source of variable fuel pressure, the nozzle including a needle valve for performing the first stage of injection, and a poppet valve for performing the second stage of injection, wherein the first stage of injection and the second stage of injection are selectable by controlling the fuel pressure in the inlet port which is common for both the needle valve and the poppet valve.

2. A fuel injection system according to claim 1, wherein the poppet valve has a poppet and a poppet return resilient means which biases the poppet valve to close the nozzle by abutting the poppet against a poppet seat formed on the nozzle, wherein the area of the poppet valve enclosed within the diameter of the poppet seat is exposed to pressure in the inlet port such that a higher pressure in the inlet port can overcome the force of the poppet return resilient means and of the pressure outside the nozzle and open the poppet valve for injection of fuel into the engine.

3. A fuel injection system according to claim 2, wherein the poppet valve has a bore connected to the inlet port and terminated at the end proximate to the poppet by at least one injection orifice which connects the bore to the engine combustion chamber, and that the needle valve is installed in the bore and is slidably engaged with the bore by a precision-matched needle guide, the needle valve forming a seat, of a diameter smaller than the diameter of the guide, which can engage with the bore to close the fluid communication between the bore and the injection orifice, the needle guide forming a needle spring chamber in which a needle return resilient means is installed to act against the poppet valve and the needle valve to bias the needle valve towards closing the fluid communication between the bore and the injection orifice, wherein the force of the needle return resilient means and the areas enclosed by the diameter of the needle guide and by the diameter of the needle seat are chosen such that a higher pressure in the inlet port can overcome the force of the needle return resilient means and open the needle valve for injection of fuel from the bore through the injection orifice into the engine.

4. A fuel injection system according to claim 3, wherein the forces of the poppet return resilient means and the needle return resilient means and the diameters of the needle guide, needle valve seat and the poppet valve seat are chosen such that, at a given pressure of the medium outside the nozzle, the pressure of the fuel in the inlet port which is necessary to open the poppet valve, is higher than the pressure in the inlet port which is necessary to open the needle valve.

5. A fuel injection system according to claim 3, wherein the nozzle comprises a return channel, wherein the needle spring chamber is connected to the return channel through an outlet control orifice.

6. A fuel injection system according to claim 5, wherein the nozzle and the poppet valve are designed to slidably engage through a precision-matched poppet guide and that the return channel is arranged to open onto the poppet guide, wherein the poppet valve can close the fluid communication between the outlet control orifice and the return channel, depending on the axial position of the poppet valve.

7. A fuel injection system according to claim 5, wherein an edge of the needle valve can close the fluid communication between the needle spring chamber and the outlet control orifice, depending on the axial position of the needle valve.

8. A fuel injection system according to claim 3, wherein a communication between the needle spring chamber and the inlet port, is open or closed depending on the axial position of the poppet valve.

9. A fuel injection system according to claim 8, wherein during the closed position of the poppet valve when its poppet is abutted against the poppet seat, the needle spring chamber is connected to the return channel via the outlet control orifice and is disconnected from the inlet port.

10. A fuel injection system according to claim 9, wherein the opening travel of the poppet valve that is necessary to hydraulically connect the needle spring chamber to the inlet port, is at least as long as the opening travel of the poppet valve necessary to hydraulically disconnect the outlet control orifice from the return channel.

11. A fuel injection system according to claim 3, wherein there is a bottom guide section with a closely matched clearance between the poppet valve and the nozzle body along the entire periphery of the guide section, wherein the fuel to be injected through the area between the poppet and the poppet seat is delivered from the bore through at least one spray orifice.

12. A fuel injection system according to claim 11, wherein there is a clearance portion which is adjacent to the poppet and has a bigger clearance to the nozzle body than the clearance in the bottom guide section, wherein the fuel to be injected through the area between the poppet and the poppet seat is delivered from the bore through at least one spray orifice that opens out onto the clearance portion.

13. A fuel injection system according to claim 5, wherein the return channel is connected to a transfer volume.

14. A fuel injection system according to claim 5, wherein there is a return conduit and that the return channel is connected to the return conduit.

15. A fuel injection system according to claim 14, wherein a hydraulic differential valve is installed between the return channel and the return conduit, the valve being designed such that it is closed when the pressure in the valve is below a feed pressure which is characteristic to a running engine and that it is open when the pressure in the valve is at or above a feed pressure which is characteristic to a running engine.

16. A fuel injection system according to claim 15, wherein a plurality of injectors are connected by their return channels to a single hydraulic differential valve.

* * * * *